US006161929A

United States Patent [19]

Erdtmann et al.

[11] Patent Number: 6,161,929

[45] **Date of Patent: *Dec. 19, 2000**

[54] INKJET IMAGES ON PVA OVERCOATED WITH HARDENER SOLUTION

[75] Inventors: David Erdtmann; Charles E. Romano; Thomas W. Martin, all of Rochester, N.Y.

[73] Assignee: Eastman Kodak Company, Rochester, N.Y.

[ * ] Notice: This patent is subject to a terminal disclaimer.

[21] Appl. No.: 09/083,875

[22] Filed: May 22, 1998

[51] Int. Cl.[7] ..... B41J 2/01

[52] U.S. Cl. ..... 347/101; 347/105; 427/337

[58] Field of Search ..... 347/96, 98, 101, 347/105, 106; 427/421, 258, 261, 265, 337, 340, 343

[56] References Cited

U.S. PATENT DOCUMENTS

| | | | |
|---|---|---|---|
| 2,059,817 | 11/1936 | Sheppard et al. | 430/621 |
| 2,992,109 | 7/1961 | Allen | 430/623 |
| 2,994,611 | 8/1961 | Heyna et al. | 430/622 |
| 3,232,763 | 2/1966 | Burness | 430/623 |
| 3,304,179 | 2/1967 | Field et al. | 430/418 |
| 3,360,372 | 12/1967 | Burness et al. | 430/621 |
| 3,490,911 | 1/1970 | Burness et al. | 430/543 |
| 3,565,632 | 2/1971 | Mills et al. | 430/621 |
| 3,635,718 | 1/1972 | Froehlich et al. | 430/622 |
| 3,640,720 | 2/1972 | Cohen | 430/622 |
| 3,642,486 | 2/1972 | Burness et al. | 430/545 |
| 3,689,274 | 9/1972 | Labude | 430/622 |
| 3,762,926 | 10/1973 | Himmelmann et al. | 430/621 |
| 4,350,788 | 9/1982 | Shimokawa et al. | 524/309 |
| 4,597,794 | 7/1986 | Ohta et al. | 106/20 |
| 5,022,947 | 6/1991 | Hasegawa et al. | 427/258 |
| 5,085,698 | 2/1992 | Ma et al. | 106/20 |
| 5,172,133 | 12/1992 | Suga et al. | 106/20 D |
| 5,324,349 | 6/1994 | Sano et al. . | |
| 5,591,508 | 1/1997 | Scarpetti | 347/105 |
| 5,847,738 | 12/1998 | Tutt et al. | 347/101 |
| 5,853,470 | 12/1998 | Martin et al. | 106/31.86 |
| 6,020,398 | 2/2000 | Erdtmann et al. | 347/100 |
| 6,031,022 | 2/2000 | Martin et al. | 523/161 |
| 6,045,219 | 4/2000 | Erdtmann et al. | 347/101 |

OTHER PUBLICATIONS

The Theory of the Photographic Process, 4th Ed., T.H. James, 1977 Macmillan Publishing Co. pp. 77–87.

Research Disclosure, vol. 365, Sep. 1994, Item 36544, II, B. Hardeners.

*Primary Examiner*—John S. Hilten
*Assistant Examiner*—Leslie J. Grohusky
*Attorney, Agent, or Firm*—Harold E. Cole

[57] ABSTRACT

A method of improving the durability of an ink jet ink image comprising the steps of: a) providing an ink jet ink receiving layer containing acetoacetylated poly(vinylalcohol); b) depositing pigment-based ink jet ink to form an image on the gelatin-containing ink receiving layer; and c) applying to the image formed in step b) a solution comprising a hardener.

19 Claims, No Drawings

INKJET IMAGES ON PVA OVERCOATED WITH HARDENER SOLUTION

CROSS REFERENCE TO RELATED APPLICATIONS

The present invention is related to commonly assigned, concurrently filed:

(1) U.S. patent application Ser. No. 09/083,673, filed May 22, 1998, entitled "PRINTING APPARATUS WITH SPRAY BAR FOR IMPROVED DURABILITY" of Wen et al.

(2) U.S. patent application Ser. No. 09/083,870, filed May 22, 1998, entitled "PRINTING APPARATUS WITH PROCESSING TANK" of Wen et al., (3) U.S. patent application Ser. No. 09/083,876, filed May 22, 1998, entitled "INK JET PRINTING APPARATUS WITH PRINT HEAD FOR IMPROVED IMAGE QUALITY" of Wen et al.

The disclosures of these related applications are incorporated herein by reference.

FIELD OF THE INVENTION

This invention relates to aqueous inks which utilize pigments as colorants and which are useful for ink jet printing applications. Specifically, this invention relates to solutions with hardeners which improve waterfastness and wet adhesion of the ink jet image when applied simultaneously with pigmented inks, or when applied over pigmented ink images printed onto acetoacetylated poly (vinylalcohol) recording elements.

BACKGROUND OF THE INVENTION

The methods and formulations employed in ink jet imaging processes involve the application of liquid ink droplets in a pixel-by-pixel manner to an ink-receiving element. There are numerous schemes which may be utilized to control the deposition of ink droplets on the image-recording element to yield the desired image. In one process, known as continuous ink jet, a continuous stream of droplets is charged and deflected in an imagewise manner onto the surface of the image-recording element, while unimaged droplets are caught and returned to the ink sump. In another process, known as drop-on-demand ink jet, individual ink droplets are projected as needed onto the image-recording element to form the desired image. Common methods of controlling the projection of ink droplets in drop-on-demand printing include piezoelectric transducers and thermal bubble formation.

The inks used in the various ink jet printers can be classified as either dye-based or pigment-based. A dye is a colorant which is molecularly dispersed or solvated by the carrier medium. The carrier medium can be a liquid or a solid at room temperature. A commonly used carrier medium is water or a mixture of water and organic cosolvents. Each individual dye molecule is surrounded by molecules of the carrier medium. In dye-based inks, no particles are observable under the microscope. Although there have been many recent advances in the art of dye-based ink jet inks, such inks still suffer from deficiencies such as low optical densities on plain paper and poor lightfastness. When water is used as the carrier medium, such inks also generally suffer from poor waterfastness.

Pigment-based inks have been gaining in popularity as a means of addressing these limitations. In pigment-based inks, the colorant exists as discrete particles. These pigment particles are usually treated with addenda known as dispersants or stabilizers which serve to keep the pigment particles from agglomerating and/or settling out. Pigment-based inks suffer from a different set of deficiencies than dye-based inks. One deficiency is related to the observation that pigment-based inks interact differently with specially coated papers and films, such as the transparent films used for overhead projection and the glossy papers and opaque white films used for high quality graphics and pictorial output. In particular, it has been observed that pigment-based inks produce imaged areas that are entirely on the surface of coated papers and films. This results in images which have poor dry and wet adhesion properties, resulting in images which can be easily smudged.

Commonly owned U.S. patent application Ser. No.08/847,858, filed Apr. 28, 1997, entitled "Pigmented Ink Jet Inks Containing Aldehydes" of Martin et al., and U.S. patent application Ser. No.08/896,520 filed Apr. 28, 1997, entitled "Pigmented Ink Jet Inks Containing Olefins" of Martin et al., disclose ink jet ink formulations containing compounds with aldehyde, blocked aldehyde and active olefinic functional groups. These references specify use of the inks on gelatin receivers. Further, they do not teach the use of a solution that is separate and distinct from the ink.

What is needed in the art is a method or formulation that will enable pigmented ink jet ink imaging to overcome the problems mentioned above when images are printed on acetoacetylated poly(vinylalcohol) (PVA) receivers. It has been unexpectedly found that when hardeners are used in conjunction with an ink-receiving layer comprised of acetoacetylated poly(vinylalcohol), superior wet abrasion resistance is obtained versus ink-receiving layer which are comprised of gelatin. This process also offers an advantage over incorporating the additives into inks since the additive can be applied in both imaged and non-imaged areas, and the laydown can be precisely controlled independently of ink laydown.

SUMMARY OF THE INVENTION

The present invention discloses a method of improving the durability of an ink jet ink image comprising the steps of:

a) providing an ink jet ink receiving layer containing acetoacetylated poly(vinylalcohol);

b) depositing pigment-based ink jet ink to form an image on the acetoacetylated poly(vinylalcohol) containing ink receiving layer; and c) applying to the image formed in step b) a solution comprising a hardener.

Also disclosed is an ink jet ink receiver comprising:

a support;

on the support, an ink jet ink receiving layer containing acetoacetylated poly(vinylalcohol);

on the ink receiving layer, an image formed by pigmented ink jet ink deposited thereon; and a fluid applied to the ink receiving layer, said fluid comprising a hardener.

We have unexpectedly found that when a solution containing hardener applied over pigmented ink drops, or when applied over a pigmented ink image where the image receiving layer is comprised of acetoacetylated poly (vinylalcohol), the waterfastness and wet adhesion properties of the image is improved.

This process offers an advantage over incorporating the hardener into inks since the hardener can be applied in both imaged and non-imaged areas, and the laydown can be precisely controlled independently of ink laydown. Hardeners are defined as any additive which causes chemical cross-linking.

Preferred hardeners include formaldehyde and compounds that contain two or more aldehyde functional groups such as glyoxal, gluteraldehyde and the like.

Other preferred hardeners include compounds that contain blocked aldehyde functional groups such as aldehydes of the type tetrahydro-4-hydroxy-5-methyl-2(1H)-pyrimidinone polymers (Sequa SUNREZ® 700), polymers of the type having a glyoxal polyol reaction product consisting of 1 anhydroglucose unit: 2 glyoxal units (SEQUAREZ® 755 obtained from Sequa Chemicals, Inc.), DME-Melamine non-fomaldehyde resins such as Sequa CPD3046-76 obtained from Sequa Chemicals Inc., 2,3-dihydroxy-1,4-dioxane (DHD), and the like. Blocked hardeners are substances, usually derived from the active hardener, that release the active compound under appropriate conditions (The Theory of the Photographic Process, $4^{th}$ Edition, T. H. James, 1977, Macmillan Publishing CO. page 81). All are employed at concentrations ranging from 0.10 to 5.0 weight percent.

Other preferred hardeners are compounds that contain active olefinic functional groups such as bis-(vinylsulfonyl)-methane (BVSM), bis-(vinylsulfonyl-methyl) ether (BVSME), 1,3,5-triacryloylhexahydro-s-triazine, and the like. In the context of the present invention, active olefinic compounds are defined as compounds having two or more olefinic bonds, especially unsubstituted vinyl groups, activated by adjacent electron withdrawing groups (The Therory of the Photographic Process, $4^{th}$ Edition, T. H. James, 1977, Macmillan Publishing Co., page 82).

The present invention relates to an aqueous solution comprising one or more humectants, a surfactant, and at least one compound containing a hardener such as glyoxal, formaldehyde, gluteraldehyde and the like. The invention also relates to the process of applying a hardener solution during or after printing with pigmented inks.

When hardener solutions of the present invention are applied over pigmented ink drops, or when applied over a pigmented ink image after printing with pigmented inks onto an acetoacetylated poly(vinylalcohol) receiver, the printed images exhibit excellent waterfastness and have excellent wet adhesion properties throughout.

The fluid may contain varying levels of matting agents for the purpose of controlling gloss, friction, and/or fingerprint resistance, surfactant(s) to improve coatability and to adjust the surface tension of the dried coating, anti-oxidants, UV absorbing compounds, light stabilizers, and the like.

DETAILED DESCRIPTION OF THE INVENTION

Inks useful for ink jet recording processes generally comprise at least a mixture of a solvent and a colorant. The preferred solvent is de-ionized water, and the colorant is either a pigment or a dye. Pigments are often preferred over dyes because they generally offer improved waterfastness and lightfastness on plain paper.

Pigmented inks are most commonly prepared in two steps:

1. a pigment milling step in which the as-received pigment is deaggregated into its primary particle size, and 2. a dilution step in which the pigment mill grind is converted into a useable ink.

Processes for preparing pigmented ink jet inks involve blending the pigment, an additive known as a stablizer or dispersant, a liquid carrier medium, grinding media, and other optional addenda such as surfactants and defoamers. This pigment slurry is then milled using any of a variety of hardware such as ball mills, media mills, high speed dispersers, and roll mills.

In the practice of the present invention, any of the known pigments can be used. The exact choice of pigment will depend upon the specific color reproduction and image stability requirements of the printer and application. For a list of pigments useful in ink jet inks, see U.S. Pat. No. 5,085,698, column 7, line 10 through column 8, line 48.

The liquid carrier medium can also vary widely and again will depend on the nature of the ink jet printer for which the inks are intended. For printers which use aqueous inks, water, or a mixture of water with miscible organic co-solvents, is the preferred carrier medium.

The dispersant is another important ingredient in the mill grind. Although there are many know dispersants known in the art, the best dispersant will be a function of the carrier medium and also often varies from pigment to pigment. Preferred dispersants for aqueous ink jet inks include sodium dodecyl sulfate, acrylic and styrene-acrylic copolymers, such as those disclosed in U.S. Pat. Nos. 5,085,698 and 5,172,133, and sulfonated styrenics, such as those disclosed in U.S. Pat. No. 4,597,794. Our most preferred dispersants are salts of oleyl methyl tauride.

In the dilution step, other ingredients are also commonly added to pigmented ink jet inks. Cosolvents (0–20 wt % of the ink) are added to help prevent the ink from drying out or crusting in the orifices of the printhead or to help the ink penetrate the receiving substrate, especially when the substrate is a highly sized paper. Preferred cosolvents for the inks of the present invention are glycerol, ethylene glycol, propylene glycol, 2-methyl-2,4-pentanediol, diethylene glycol, and mixtures thereof, at overall concentrations ranging from 5 to 20 wt % of the ink.

A biocide (0.0001–1.0 wt % of the ink) may be added to prevent unwanted microbial growth which may occur in the ink over time. A preferred biocide for the inks of the present invention is Proxel GXL™ (1,2-benziso thiozolin-3-one) obtained from Zeneca Colours) at a final concentration of 0.005–0.5 wt %.

Additional additives which may optionally be present in ink jet inks include thickeners, conductivity enhancing agents, anti-kogation agents, drying agents, and defoamers.

In the context of the present invention, an aqueous solution comprising one or more co-solvents, a surfactant, and a hardener is applied to the pigmented inkjet image in a non-imagewise fashion either through a separate thermal or piezoelectric printhead, or in any other method which would be able to apply the hardener solution evenly to the image (e.g., a spray bar). Alternatively, the receiver with the image can be processed in a tank containing the hardener solution. Methods of applying the hardener solution are disclosed in commonly owned U.S. patent application Ser. No. 09/083,673, filed May 22, 1998, entitled "Printing Apparatus With Spray Bar For Improved Durability" of Wen et al., U.S. patent application Ser. No. 09/083,870, filed May 22, 1998, entitled "Printing Apparatus With Processing Tank" of Wen et al., U.S. patent application Ser. No. 09/083,876, filed May 22, 1998, entitled "Ink Jet Printing Apparatus With Print Head For Improved Image Quality" of Wen et al., filed on even date herewith. The contents of these applications are incorporated herein in their entirety.

For the practice of the present invention, some useful hardeners are organic compounds selected from formaldehyde, glutaraldehyde, succinaldehyde, and glyoxal. Hardeners are used at concentrations ranging from 0.10 to 5.0 weight percent of active ingredient in the solution; preferably 0.25 to 2.0 weight percent.

Suitable compounds that contain active olefinic functional groups include a compound selected from divinyl ketone; resorcinol bis(vinylsulfonate); 4,6-bis(vinylsulfonyl)-m-xylene; bis(vinylsulfonylalkyl) ethers and amines; 1,3,5-tris (vinylsulfonyl) hexahydro-s-triazine; diacrylamide; 1,3-bis (acryloyl)urea; N,N'-bismaleimides; bisisomaleimides; bis (2-acetoxyethyl) ketone; 1,3,5-triacryloylhexahydro-s-triazine; and blocked active olefins of the type bis(2-acetoxyethyl) ketone and 3,8-dioxodecane-1,10-bis (pyridinium perchlorate).

Most preferred is bis-(vinylsulfonyl)-methane (BVSM) and bis(vinylsulfonylmethyl) ether (BVSME).

Other suitable organic compounds are selected from formaldehyde and dialdehydes such as, the homologous series of dialdehydes ranging from glyoxal to adipaldehyde, diglycolaldehyde, and aromatic dialdehydes.

Preferred are formaldehyde, glutaraldehyde, succinaldehyde, and glyoxal.

Suitable blocked aldehydes are selected from blocked dialdehydes and N-methylol compounds such as 2,3-dihydroxy-1,4-dioxane (DHD); tetrahydro-4-hydroxy-5-methyl-2(1H)-pyrimidinone polymers; polymers of the type having a glyoxal polyol reaction product consisting of 1 anhydroglucose unit: 2 glyoxal units; DME-Melamine non-formaldehyde resins; N-methylol compounds obtained from the condensation of formaldehyde with various aliphatic or cyclic amides, ureas, and nitrogen heterocycles. Preferred is 2,3-dihydroxy-1,4-dioxane (DHD).

Besides those already listed above, it is contemplated that other aldehyde containing compounds that are effective hardeners are also useful in the practice of this invention. Some compounds known to be effective hardeners are 3-hydroxybutyraldehyde (U.S. Pat. No. 2,059,817), crotonaldehyde, the homologous series of dialdehydes ranging from glyoxal to adipaldehyde, diglycolaldehyde (U.S. Pat. No. 3,304,179) various aromatic dialdehydes (U.S. Pat. Nos. 3,565,632 and 3,762,926), and polymeric dialdehydes such as dialdehyde starch and dialdehyde derivatives of plant gums. Most preferred are formaldehyde, glutaraldehyde, succinaldehyde, and glyoxal.

Likewise, it is also contemplated that other hardeners may be useful in the context of this invention. Some compounds known to be effective hardeners are blocked aldehydes such as 2,3-dihydroxy-1,4-dioxane (DHD), tetrahydro-4-hydroxy-5-methyl-2(1H)-pyrimidinone polymers, polymers of the type having a glyoxal polyol reaction product consisting of 1 anhydroglucose unit: 2 glyoxal units; DME-Melamine non-formaldehyde resins; N-methylol compounds obtained from the condensation of formaldehyde with various aliphatic or cyclic amides, ureas, and nitrogen heterocycles. Most preferred is 2,3-dihydroxy-1,4-dioxane (DHD) at concentrations ranging from 0.10 to 5.0 weight percent of active ingredient in the solution.

It is contemplated that compounds with active olefinic functionality, that are effective hardeners are also useful in the practice of this invention. Some compounds known to be effective hardeners are divinyl ketone, resorcinol bis (vinylsulfonate) (U.S. Pat. No. 3,689,274), 4,6-bis (vinylsulfonyl)-m-xylene (U.S. Pat. No. 2,994,611), bis (vinylsulfonylalkyl) ethers and amines (U.S. Pat. Nos. 3,642,486 and 3,490,911), 1,3,5-tris(vinylsulfonyl) hexahydro-s-triazine, diacrylamide (U.S. Pat. No. 3,635,718), 1,3-bis(acryloyl)urea (U.S. Pat. No. 3,640,720), N,N'-bismaleimides (U.S. Pat. No. 2,992,109) bisisomaleimides (U.S. Pat. No. 3,232,763), bis(2-acetoxyethyl) ketone (U.S. Pat. No. 3,360,372), and 1,3,5-triacryloylhexahydro-s-triazine. Blocked active olefins of the type bis(2-acetoxyethyl) ketone and 3,8-dioxodecane-1,10-bis (pyridinium perchlorate) may also be used. Most preferred is BVSM and BVSME at concentrations ranging from 0.10 to 5.0 weight percent of active ingredient in the solution.

Other compounds which may act as hardeners include: acetylenes, azides, aziridines, carboxylic acid derivatives, epoxides such as glycidyl ethers and glycidylammonium salts, active halogen compounds, isocyanate adducts, diketones, methylol Melamines, oxazolines, organometallics such as Volan™ (a complex of methacrylic acid and chromium III chloride) mucochloric acid, and polymeric hardeners.

In addition there may be a synergistic effect from certain combinations of the above mentioned hardeners.

Additional related hardeners can be found in, The Theory of the Photographic Process, $4^{th}$ Edition, T. H. James, 1977, Macmillan Publishing CO. pages 77–87, and in *Research Disclosure*, Vol. 365, September 1994, Item 36544, II, B. Hardeners.

EXAMPLES

Examples of Aldehydes (ALD)

ALD Comparative Example 1A

| Mill Grind | |
|---|---|
| Polymeric beads, mean diameter of 50 μm (milling media) | 325.0 g |
| Bis(phthalocyanylalumino)tetra-Phenyldisiloxane (cyan pigment) Manufactured by Eastman Kodak | 35.0 g |
| Oleoyl methyl taurine, (OMT) sodium salt | 17.5 g |
| Deionized water | 197.5 g |
| Proxel GXL ™ (biocide from Zeneca) | 0.2 g |

The above components were milled using a high energy media mill manufactured by Morehouse-Cowles Hochmeyer. The mill was run for 8 hours at room temperature. An aliquot of the above dispersion to yield 1.12 g pigment was mixed with 3.98 g diethylene glycol, 6.03 g glycerol, and additional deionized water for a total of 50.0 g. This ink was filtered through 3-μm filter and introduced into an empty Hewlett-Packard 51626A print cartridge. Images were made with a Hewlett-Packard DeskJet™ 540 printer on medium weight resin coated paper containing an imaging layer.

The resin coated paper stock had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei). Poor waterfastness and wet adhesion were observed.

ALD Comparative Examples 1B–1D

Inks were prepared in a similar manner as described in ALD Comparative Example 1A except, the cyan pigment was replaced by a quinacridone magenta (pigment red 122) from Sun Chemical Co., Hansa Brilliant Yellow (pigment yellow 74) from Hoechst Chemical Co. or Black Pearls 880 manufactured by Cabot Chemical Company. The inks were printed as in ALD Comparative Example 1A and poor waterfastness and wet adhesion were observed in each sample.

ALD Comparative Example 2

An ink was prepared in the same manner as that described in ALD Comparative Example 1A except that an aliquot of the above cyan dispersion to yield 1.12 g pigment was mixed with 8.0 g of diethylene glycol, and 1.35 g of 37 wt % solution of formaldehyde obtained from Aldrich Chemicals was added to the mixture to obtain a final formaldehyde concentration of 1.00 wt % of hardener in the ink, and additional deionized water for a total of 50.0 g. This ink was printed on resin coated paper stock which bad been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei). Excellent waterfastness and wet adhesion were observed in the 100% fill areas ($D_{max}$); however at lower density patches, and with thin narrow lines (~1/32$^{nd}$ of an inch), very poor wet adhesion was observed.

ALD Comparative Example 3

An ink was prepared in the same manner as that described in ALD Comparative Example 1A, however 0.38 g of 40 wt % solution of glyoxal obtained from Aldrich Chemicals was added to the mixture to obtain a final glyoxal concentration of 0.30 wt %. This ink was printed on resin coated paper stock which had been previously treated with a corona discharge treatment (CDT) and coated with an imaging layer consisting of about 800 mg/ft$^2$ of an acetoacetylated poly (vinylalcohol) (Gohsefimer Z-200, Nippon Gohsei). Excellent waterfastness and wet adhesion were observed in the 100% fill areas ($D_{max}$); however at lower density patches, and with thin narrow lines (~1/32$^{nd}$ of an inch), very poor wet adhesion was observed.

ALD Comparative Example 4

An ink was prepared in the same manner as that described in ALD Comparative Example 1A except, an aliquot of the above cyan dispersion to yield 1.0 g pigment was mixed with 8.0 g of diethylene glycol, and additional deionized water for a total of 50.0 g. This ink was printed on resin coated paper stock which had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei).

A solution consisting of 8.0 g of diethylene glycol, 1.25 g of a 0.50% solution of Dupont Zonyl® FSN, and 0.70 g of 100 wt % solution of ethylenediamine dihydrochloride obtained from Aldrich Chemicals to obtain a final concentration of 1.40 wt % of hardener in the solution, and additional deionized water for a total of 50.0 g was prepared. The overcoat solution was introduced into an empty Hewlett-Packard 51626A print cartridge. This solution was overcoated at 100% coverage on the above pigmented ink image. Poor waterfastness and wet adhesion were observed in the 100% fill areas ($D_{max}$). Poor waterfastness and wet adhesion properties were also observed at lower density patches, and with thin narrow lines (~1/32$^{nd}$ of an inch).

ALD Comparative Example 5

An ink was prepared in the same manner as that described in ALD Example 4. This ink was printed on resin coated paper stock which had been previously treated with a corona discharge treatment (CDT) and coated with an imaging layer consisting of about 800 mg/ft$^2$ of a non-modified poly (vinylalcohol) (Gohsefimer K-210, Nippon Gohsei).

A solution consisting of 8.0 g of diethylene glycol, 6.25 g of a 0.50% solution of Dupont Zonyl™ FSA, and 1.75 g of 40 wt % solution of glyoxal obtained from Aldrich Chemicals to obtain a final hardener concentration of 1.40 wt % of hardener in the solution, and additional deionized water for a total of 50.0 g was prepared. This overcoat solution was printed over the pigmented ink image as in the previous example. Poor waterfastness and wet adhesion were observed.

ALD Comparative Example 6

An ink was prepared and printed in the same manner as that described in ALD Example 5, except the cyan pigment was replaced by 1.45 g of a quinacridone magenta (pigment red 122) from Sun Chemical Co.

A solution consisting of 8.0 g of diethylene glycol, 6.25 g of a 0.50% solution of Dupont Zonyl™ FSA, and 1.75 g of 40 wt % solution of glyoxal obtained from Aldrich Chemicals to obtain a final glyoxal concentration of 1.40 wt % of hardener in the solution, and additional deionized water for a total of 50.0 g was prepared. This overcoat solution was printed over the pigmented ink image as in the previous examples. Poor waterfastness and wet adhesion were observed.

ALD Example 7

An ink was prepared in the same manner as that described in ALD Comparative Example 1A except, an aliquot of the above cyan dispersion to yield 1.0 g pigment was mixed with 8.0 g of diethylene glycol, and additional deionized water for a total of 50.0 g. This ink was printed on resin coated paper stock which had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei).

A solution consisting of 8.0 g of diethylene glycol, 2.50 g of a 0.50% solution of Dupont Zonyl® FSN, and 1.89 g of 37 wt % solution of formaldehyde obtained from Aldrich Chemicals to obtain a final hardener concentration of 1.40 wt % of hardener in the solution, and additional deionized water for a total of 50.0 g was prepared. This solution was overcoated on the above pigmented ink image. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

ALD Example 8

An ink was prepared and printed in the same manner as that described in ALD Example 7. A solution consisting of 8.0 g of diethylene glycol, 6.25 g of a 0.50% solution of Dupont Zonyl® FSA, and 1.75 g of 40 wt % solution of glyoxal obtained from Aldrich Chemicals to obtain a final glyoxal concentration of 1.40 wt % of hardener in the solution, and additional deionized water for a total of 50.0 g was prepared. This overcoat solution was printed over the pigmented ink image as in the previous examples. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

ALD Example 9

An ink was prepared and printed in the same manner as that described in ALD Example 7, except the cyan pigment was replaced by 1.45 g of a quinacridone magenta (pigment red 122) from Sun Chemical Co.

A solution consisting of 8.0 g of diethylene glycol, 6.25 g of a 0.50% solution of Dupont Zonyl® FSA, and 1.75 g of 40 wt % solution of glyoxal obtained from Aldrich Chemicals to obtain a final concentration of 1.40 wt % of hardener in the solution, and additional deionized water for a total of 50.0 g was prepared. This overcoat solution was printed over the pigmented ink image as in the previous examples. Excellent waterfastness and wet adhesion was observed in the 100% fill areas ($D_{max}$). Excellent waterfastness and wet adhesion properties was also observed at lower density patches, and with thin narrow lines (~$1/32^{nd}$ of an inch).

Ink Characterization

The images printed from the examples were evaluated by measuring the optical densities in three area patches with maximum ink coverage, and averaging, using an X-Rite™ Photographic Densitometer.

Waterfastness was determined by immersing samples of printed images in distilled water for I hour and then allowed to dry for at least 12 hours. The optical density was measured before immersion in water and after immersion in water and drying. Waterfastness is determined as the per cent of retained optical density after immersion in water and drying. After the samples had been immersed in water for half an hour the samples were physically rubbed to ascertain if the pigmented ink image would rub off with pressure (wet adhesion). This was done on a $D_{max}$ patch (100% fill), at a mid-density point (0.50–1.0), and on narrow lines (~$1/32^{nd}$ of an inch). They were subjectively rated based on the following scale: excellent=no discerable difference in image density or appearance, very good=very slight density loss, good=moderate density loss, fair=image rubs of easily, and poor=image floats off surface of paper while immersed in water.

receiving layer containing acetoacetylated poly (vinylalcohol), superior wet abrasion resistance is obtained versus an ink-receiving layer which is comprised of gelatin.

EXAMPLES OF BLOCKED ALDEHYDES (BALD)

BALD Comparative Example 1A

| Mill Grind | |
|---|---|
| Polymeric beads, mean diameter of 50 μm (milling media) | 325.0 g |
| Bis(phthalocyanylalumino)tetra-Phenyldisiloxane (cyan pigment) Manufactured by Eastman Kodak | 35.0 g |
| Oleoyl methyl taurine, (OMT) sodium salt | 17.5 g |
| Deionized water | 197.5 g |
| Proxel GXL ™ (biocide from Zeneca) | 0.2 g |

The above components were milled using a high energy media mill manufactured by Morehouse-Cowles Hochmeyer. The mill was run for 8 hours at room temperature. An aliquot of the above dispersion to yield 1.12 g pigment was mixed with 3.98 g diethylene glycol, 6.03 g glycerol, and additional deionized water for a total of 50.0 g. This ink was filtered through 3-μm filter and introduced into an empty Hewlett-Packard 51626A print cartridge. Images were made with a Hewlett-Packard DeskJet™ 540 printer on medium weight resin coated paper containing an imaging layer.

The resin coated paper stock had been previously treated with a corona discharge treatment(CDT) and coated with an imaging layer consisting of about 800 mg/ft$^2$ of an acetoacetylated poly(vinylalcohol) (Gohsefimer Z-200, Nippon Gohsei). Poor waterfastness and wet adhesion was observed.

BALD Comparative Examples 1B–1D

Inks were prepared in a similar manner as described in BALD Comparative Example 1A except that the cyan pigment was replaced by a quinacridone magenta (pigment red 122) from Sun Chemical Co., Hansa Brilliant Yellow (pigment yellow 74) from Hoechst Chemical Co. or Black Pearls 880 manufactured by Cabot Chemical Company. The inks were printed as in BALD Comparative Example 1A and poor waterfastness and wet adhesion were observed in each sample.

TABLE 1

| Example | Receiver | % Pigment | Overcoat Additive | Density Before | Density After | % Retained Density | Wet Adhesion ($D_{max}$ Patch) | Wet Adhesion (Lines) |
|---|---|---|---|---|---|---|---|---|
| ALD Comp. 1 | Z-200 | 2.25 | None | 1.11 | 0 | 0 | Poor | Poor |
| ALD Comp. 1B | Z-200 | 2.60 | None | 1.73 | .05 | 3 | Poor | Poor |
| ALD Comp. 1C | Z-200 | 2.25 | None | 1.84 | .01 | 0 | Poor | Poor |
| ALD Comp. 1D | Z-200 | 2.25 | None | 1.91 | .04 | 2 | Poor | Poor |
| ALD Comp. 2 | Z-200 | 2.00 | None | 1.72 | 1.50 | 87 | Excellent | Poor |
| ALD Comp. 3 | Z-200 | 2.25 | None | 1.39 | 1.25 | 90 | Excellent | Poor |
| ALD Comp. 4 | Z-200 | 2.00 | EDHC | 1.28 | .10 | 7 | Poor | Poor |
| ALD Comp. 5 | K-210 | 2.00 | glyoxal | 1.70 | 0 | 0 | Poor | Poor |
| ALD Comp. 6 | K-210 | 2.00 | glyoxal | 1.39 | 0 | 0 | Poor | Poor |
| ALD 7 | Z-200 | 2.00 | FA | 1.36 | 1.25 | 92 | Excellent | Excellent |
| ALD 8 | Z-200 | 2.00 | glyoxal | 1.37 | 1.32 | 96 | Excellent | Excellent |
| ALD 9 | Z-200 | 2.90 | glyoxal | 1.72 | 1.66 | 96 | Excellent | Excellent |

ALD = Aldehyde; FA = formaldehyde; K-210 = poly(vinylalcohol) (Gohsefimer K-210, Nippon Gohsei); EDHC = ethylenediamine dihydrochloride Z-200 = acetoacetylated poly(vinylalcohol) (Gohsefimer Z-200, Nippon Gohsei);

The results indicate that significant enhancement of the waterfastness and wet adhesion properties of printed images, printed on acetoacetylated poly(vinylalcohol), can be achieved when an overcoat solution containing aldehydes such as formaldehyde and glyoxal are overcoated onto the pigmented ink image. It has been unexpectedly found that when aldehydes are used in conjunction with an ink- BALD Comparative Example 2

An ink was prepared in the same manner as that described in BALD Comparative Example 1A except that 1.09 g of 55 wt % solution of a glyoxal polyol reacation product consisting of 1 anhydroglucose unit: 2 glyoxal units (SEQUAREZ® 755 obtained from Sequa Chemicals, Inc.) was added to the mixture to obtain a final concentration of 1.20 wt % of hardener in the ink. This ink was printed on resin coated paper stock which had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei). Excellent waterfastness and wet adhesion were observed in the 100% fill areas ($D_{max}$); however at lower density patches, and with thin narrow lines (~1/32$^{nd}$ of an inch), very poor wet adhesion was observed.

BALD Comparative Example 3

An inks was prepared in the same manner as that described in BALD Comparative Example 2, however the SEQUAREZ® 755 was replaced with 1.11 g of 45 wt % solution of a cyclic urea glyoxal condensate consisting of 1 cyclic urea unit: 1 glyoxal unit (SUNREZ® 700 obtained from Sequa Chemicals, Inc.) to obtain a final concentration of 1.00 wt % of hardener in the ink. This ink was printed on resin coated paper stock which had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei). Excellent waterfastness and wet adhesion was observed in the 100% fill areas ($D_{max}$); however at lower density patches, and with thin narrow lines (~1/32$^{nd}$ of an inch), very poor wet adhesion were observed.

BALD Comparative Example 4

An ink was prepared in the same manner as that described in BALD Comparative Example 3, except that the SUNREZ® 700 was replaced with 5.00 g of 10 wt % solution of 2,3-dihydroxy-1,4-dioxane (DHD) obtained from Aldrich to obtain a final hardener concentration of 1.00 wt % of hardener in the ink. This ink was printed on resin coated paper stock which had been previously treated with a corona discharge treatment (CDT) and coated with an imaging layer consisting of about 800 mg/ft$^2$ of an acetoacetylated poly (vinylalcohol) (Gohsefimer Z-200, Nippon Gohsei). Excellent waterfastness and wet adhesion were observed in the 100% fill areas ($D_{max}$); however at lower density patches, and with thin narrow lines (~1/32$^{nd}$ of an inch), very poor wet adhesion was observed.

BALD Comparative Example 5

An ink was prepared in the same manner as that described in BALD Comparative Example 1. This ink was printed on resin coated paper stock which had been previously treated with a corona discharge treatment (CDT) and coated with an imaging layer consisting of about 800 mg/ft$^2$ of a non-modified poly(vinylalcohol) (Gohsefimer K-210, Nippon Gohsei).

A solution consisting of 8.0 g of diethylene glycol, 6.25 g of a 0.50% solution of Dupont Zonyl® FSA, and 1.56 g of 45 wt % solution of a cyclic urea glyoxal condensate consisting of 1 cyclic urea unit: 1 glyoxal unit (SUNREZ® 700 obtained from Sequa Chemicals, Inc.) to obtain a final concentration of 1.40 wt % of hardener in the solution, and additional deionized water for a total of 50.0 g was prepared. The overcoat solution was introduced into an empty Hewlett-Packard 51626A print cartridge. This solution was overcoated at 100% coverage on the above pigmented ink and poor waterfastness and wet adhesion were observed.

BALD Comparative Example 6

An ink was prepared in the same manner as that described in BALD Comparative Example 5, except the cyan pigment was replaced by a quinacridone magenta (pigment red 122) from Sun Chemical Co. The pigmented ink was printed and then overcoated as in BALD Comparative Example 5. Poor waterfastness and wet adhesion were observed.

BALD Comparative Example 7

An ink was prepared in the same manner as that described in BALD Comparative Example 5 and was printed as in Example 5. An overcoat solution was prepared as in BALD Comparative Example 5 except the SUNREZ® 700 was replaced 1.27 g of 55 wt % solution of a glyoxal polyol reacation product consisting of 1 anhydroglucose unit: 2 glyoxal units (SEQUAREZ® 755 obtained from Sequa Chemicals, Inc.) was added to the mixture to obtain a final concentration of 1.40 wt % of hardener in the solution. The pigmented ink image was overcoated using the above solution as in BALD Comparative Example 5. Poor waterfastness and wet adhesion were observed.

BALD Comparative Example 8

An ink was prepared and printed in the same manner as that described in BALD Comparative Example 6. An overcoat solution was prepared as in BALD Comparative Example 7. This overcoat solution was printed over the pigmented ink image as in the previous examples. Poor waterfastness and wet adhesion were observed.

BALD Example 9

An ink and overcoat solution was prepared in the same manner as that described in BALD Comparative Example 5. The ink was printed on resin coated paper stock which had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei). The pigmented ink image was then overcoated as in BALD Comparative Example 5. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

BALD Example 10

An ink and overcoat solution was prepared in the same manner as that described in BALD Comparative Example 6. The ink was printed on resin coated paper stock which had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei). The pigmented ink image was then overcoated as in BALD Comparative Example 6. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

BALD Example 11

An ink and overcoat solution was prepared in the same manner as that described in BALD Example 7. The ink was printed on resin coated paper stock which had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei). The pigmented ink image was then overcoated as in BALD Comparative Example 7. Excellent waterfastness and very good wet adhesion were observed in the 100% fill areas ($D_{max}$). Excellent waterfastness and very good wet adhesion properties were also observed at lower density patches, and with thin narrow lines (~1/32$^{nd}$ of an inch).

BALD Example 12

An ink and overcoat solution was prepared in the same manner as that described in BALD Comparative Example 8. The ink was printed on resin coated paper stock which had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei). The pigmented ink image was then overcoated as in Example 8. Excellent waterfastness and very good wet adhesion were observed in the 100% fill areas ($D_{max}$). Excellent waterfastness and very good wet adhesion properties were also observed at lower density patches, and with thin narrow lines (~1/32$^{nd}$ of an inch).

BALD Example 14

An ink was prepared as in BALD Comparative Example 5. An overcoat solution consisting of 8.0 g of diethylene glycol, 5.00 g of a 0.50% solution of Dupont Zonyl® FSA, and 0.70 g of 62 wt % solution of a DME-Melamine non-fomaldehyde resin (Sequa CPD3046-76 obtained from Sequa Chemicals Inc.) to obtain a final hardener concentration of 1.40 wt % of hardener in the solution. was prepared. This solution was overcoated on the above pigmented ink image. Excellent waterfastness and good wet adhesion were observed in the 100% fill areas ($D_{max}$). Excellent waterfastness and very good wet adhesion properties were also observed at lower density patches, and with thin narrow lines (~1/32$^{nd}$ of an inch).

Ink Characterization

The images printed from the examples were evaluated by measuring the optical densities in three area patches with maximum ink coverage, and averaging, using an X-Rite™ Photographic Densitometer.

Waterfastness was determined by the method described above for Aldehyde (ALD) Examples.

TABLE 2

| BALD Example | Receiver | % Pigment | Overcoat Additive | Density Before | Density After | % Retained Density | Wet Adhesion ($D_{max}$ Patch) | Wet Adhesion (Lines) |
|---|---|---|---|---|---|---|---|---|
| BALD Comp. 1 | Z-200 | 2.25 | None | 1.11 | 0 | 0 | Poor | Poor |
| BALD Comp. 1B | Z-200 | 2.60 | None | 1.73 | .05 | 3 | Poor | Poor |
| BALD Comp. 1C | Z-200 | 2.25 | None | 1.84 | .01 | 0 | Poor | Poor |
| BALD Comp. 1D | Z-200 | 2.25 | None | 1.91 | .04 | 2 | Poor | Poor |
| BALD Comp. 2 | Z-200 | 2.25 | None | 1.41 | 1.29 | 92 | Excellent | Poor |
| BALD Comp. 3 | Z-200 | 2.25 | None | 2.02 | 2.03 | 100 | Excellent | Poor |
| BALD Comp. 4 | Z-200 | 2.25 | None | 2.30 | 2.20 | 96 | Excellent | Poor |
| BALD Comp. 5 | K-210 | 2.00 | SunRez 700M | 1.71 | 0 | 0 | Poor | Poor |
| BALD Comp. 6 | K-210 | 2.90 | SunRez 700M | 1.39 | 0 | 0 | Poor | Poor |
| BALD Comp. 7 | K-210 | 2.00 | SequaRez 755 | 1.73 | 0 | 0 | Poor | Poor |
| BALD Comp. 8 | K-210 | 2.90 | SequaRez 755 | 1.38 | 0 | 0 | Poor | Poor |
| BALD 9 | Z-200 | 2.00 | SunRez 700M | 1.33 | 1.29 | 97 | Excellent | Excellent |
| BALD 10 | Z-200 | 2.90 | SunRez 700M | 1.61 | 1.58 | 98 | Excellent | Excellent |
| BALD 11 | Z-200 | 2.00 | SequaRez 755 | 1.29 | 1.23 | 95 | Very Good | Very Good |
| BALD 12 | Z-200 | 2.90 | SequaRez 755 | 1.68 | 1.60 | 95 | Very Good | Very Good |
| BALD 13 | Z-200 | 2.00 | DHD | 1.25 | 1.19 | 95 | Excellent | Excellent |
| BALD 14 | Z-200 | 2.00 | Sequa CPD3046-76 | 1.40 | 1.28 | 91 | Good | Very Good |

BALD = Blocked Aldehydes; K-210 = poly(vinylalcohol) (Gohsefimer K-210, Nippon Gohsei); DHD = 2,3-dihydroxy-1,4-dioxane Z-200 = acetoacetylated poly(vinylalcohol) (Gohsefimer Z-200, Nippon Gohsei); SequaRez 755 = glyoxal polyol reacation product consisting of 1 anhydroglucose unit: 2 glyoxal units (SEQUAREZ ® 755 obtained from Sequa Chemicals, Inc.); SunRez 700M = cyclic urea glyoxal condensate consisting of 1 cyclic urea unit: 1 glyoxal unit (SUNREZ ® 700 obtained from Sequa Chemicals, Inc.); Sequa CPD3046-76 = DME-Melamine non-fomaldehyde resin (Sequa CPD3046-76 obtained from Sequa Chemicals Inc.)

BALD Example 13

An ink was prepared as in BALD Comparative Example 5. An overcoat solution consisting of 8.0 g of diethylene glycol, 2.50 g of a 0.50% solution of Dupont Zonyl® FSN, and 7.0 g of 10 wt % solution of 2,3-dihydroxy-1,4-dioxane (DHD) obtained from Aldrich to obtain a final hardener concentration of 1.40 wt % of hardener in the solution was prepared. This solution was overcoated on the above pigmented ink image. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

The results indicate that significant enhancement of the waterfastness and wet adhesion properties of printed images, printed onacetoacetylated poly(vinylalcohol), can be achieved when an overcoat solution containing blocked aldehydes such as 2,3-dihydroxy-1,4-dioxane (DHD), SUNREZ® 700, SEQUAREZ® 755 and Sequa CPD3046-76 are overcoated onto the pigmented ink image. It has been unexpectedly found that when blocked aldehydes are used in conjunction with an ink-receiving layer containing an acetoacetylated poly(vinylalcohol), superior wet abrasion resistance is obtained versus an ink-receiving layer which is comprised of gelatin.

EXAMPLES OF ACTIVE OLEFINS (OLF)

OLF Comparative Example 1A

| Mill Grind | |
|---|---|
| Polymeric beads, mean diameter of 50 $\mu$m (milling media) | 325.0 g |
| Bis(phthalocyanylalumino)tetra-Phenyldisiloxane (cyan pigment) Manufactured by Eastman Kodak | 35.0 g |
| Oleoyl methyl taurine, (OMT) sodium salt | 17.5 g |
| Deionized water | 197.5 g |
| Proxel GXL ™ (biocide from Zeneca) | 0.2 g |

The above components were milled using a high energy media mill manufactured by Morehouse-Cowles Hochmeyer. The mill was run for 8 hours at room temperature. An aliquot of the above dispersion to yield 1.12 g pigment was mixed with 3.98 g diethylene glycol, 6.03 g glycerol, and additional deionized water for a total of 50.0 g. This ink was filtered through 3-$\mu$m filter and introduced into an empty Hewlett-Packard 51626A print cartridge. Images were made with a Hewlett-Packard DeskJet™ 540 printer on medium weight resin coated paper containing an imaging layer.

The resin coated paper stock had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei). Poor waterfastness and wet adhesion were observed.

OLF Comparative Examples 1B–1D

Inks were prepared in a similar manner as described in OLF Comparative Example 1A except, the cyan pigment was replaced by a quinacridone magenta (pigment red 122) from Sun Chemical Co., Hansa Brilliant Yellow (pigment yellow 74) from Hoechst Chemical Co. or Black Pearls 880 manufactured by Cabot Chemical Company. The inks were printed as in OLF Comparative Example 1A and poor waterfastness and wet adhesion were observed in each sample.

OLF Comparative Example 2

An ink was prepared in the same manner as that described in OLF Comparative Example 1A, except that 13.89 g of 1.8 wt % solution of BVSM was added to the mixture to obtain a final BVSM concentration of 0.50 wt %. This was printed onto coatings of paper stock which had previously been corona discharge treated (CDT) and which had been coated with an imaging layer consisting of about 800 mg/ft$^2$ of an acetoacetylated poly(vinylalcohol) (Gohsefimer Z-200, Nippon Gohsei). Good waterfastness and wet adhesion were observed in the 100% fill areas ($D_{max}$); however at lower density patches, and with thin narrow lines (~$1/32^{nd}$ of an inch), very poor wet adhesion were observed.

(OLF) Comparative Example 3

An ink was prepared in the same manner as that described in OLF Comparative Example 2, except 27.78 g of 1.8 wt % solution of BVSM was added to the mixture to obtain a final BVSM concentration of 1.00 wt % of hardener in the ink. This was printed onto coatings of paper stock which had previously been corona discharge treated (CDT) and which had been coated with an imaging layer consisting of about 800 mg/ft$^2$ of an acetoacetylated poly(vinylalcohol) (Gohsefimer Z-200, Nippon Gohsei). Excellent waterfastness and wet adhesion were observed in the 100% fill areas ($D_{max}$); however at lower density patches, and with thin narrow lines (~$1/32^{nd}$ of an inch), very poor wet adhesion were observed.

OLF Comparative Example 4

An ink was prepared in the same manner as that described in OLF Example Comparative 2, except the BVSM was replaced with 12.50 g of 2.0 wt % solution of BVSME to obtain a final BVSME concentration of 0.50 wt % of hardener in the ink. This was printed onto coatings of paper stock which had previously been corona discharge treated (CDT) and which had been coated with an imaging layer consisting of about 800 mg/ft$^2$ of an acetoacetylated poly (vinylalcohol) (Gohsefimer Z-200, Nippon Gohsei). Fair waterfastness and wet adhesion were observed in the 100% fill areas ($D_{max}$); however at lower density patches, and with thin narrow lines (~$1/32^{nd}$ of an inch), very poor wet adhesion was observed.

OLF Comparative Example 5

An ink was prepared in the same manner as that described in OLF Comparative Example 4, except 25.00 g of 2.0 wt % solution of BVSME was added to the mixture to obtain a final BVSME concentration of 1.00 wt % of hardener in the ink. This was printed onto coatings of paper stock which had previously been corona discharge treated (CDT) and which had been coated with an imaging layer consisting of about 800 mg/ft$^2$ of an acetoacetylated poly(vinylalcohol) (Gohsefimer Z-200, Nippon Gohsei). Good waterfastness and wet adhesion were observed in the 100% fill areas ($D_{max}$); however at lower density patches, and with thin narrow lines (~$1/32^{nd}$ of an inch), very poor wet adhesion was observed.

OLF Example 6

An ink was prepared in the same manner as that described in OLF Comparative Example 1, except that the final pigment concentration was 2.0 wt %. This ink was printed on resin coated paper stock which had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei).

A solution consisting of 8.0 g of diethylene glycol, 2.50 g of a 0.50% solution of Dupont Zonyl® FSN, and 38.89 g of 1.8 wt % solution of BVSM to obtain a final concentration of 1.40 wt % of hardener in the solution, and additional deionized water for a total of 50.0 g was prepared The overcoat solution was introduced into an empty Hewlett-Packard 51626A print cartridge. This solution was overcoated at 100% coverage on the above pigmented ink image. Excellent waterfastness and wet adhesion were observed in the 100% fill areas ($D_{max}$). Excellent waterfastness and wet adhesion properties were also observed at lower density patches, and with thin narrow lines (~$1/32^{nd}$ of an inch).

OLF Example 7

An ink was prepared and printed as in OLF Example 6. An overcoat solution consisting of 8.0 g of diethylene glycol, 2.50 g of a 0.50% solution of Dupont Zonyl® FSN, and 35.0 g of 2 wt % solution of BVSME to obtain a final hardener concentration of 1.40 wt % of hardener in the solution was prepared. This solution was overcoated on the above pigmented ink image. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Ink Characterization

The images printed from the examples were evaluated by measuring the optical densities in three area patches with maximum ink coverage, and averaging, using an X-Rite™ Photographic Densitometer.

Waterfastness was determined by the method described above for Aldehde Examples (ALD).

TABLE 3

| Example | Receiver | % Pigment | Overcoat Additive | Density Before | Density After | % Retained Density | Wet Adhesion ($D_{max}$ Patch) | Wet Adhesion (Lines) |
|---|---|---|---|---|---|---|---|---|
| OLF Comp. 1A | Z-200 | 2.25 | None | 1.11 | 0 | 0 | Poor | Poor |
| OLF Comp. 1B | Z-200 | 2.60 | None | 1.73 | .05 | 3 | Poor | Poor |
| OLF Comp. 1C | Z-200 | 2.25 | None | 1.84 | .01 | 0 | Poor | Poor |
| OLF Comp. 1D | Z-200 | 2.25 | None | 1.91 | .04 | 2 | Poor | Poor |
| OLF Comp. 2 | Z-200 | 2.25 | None | 1.97 | 1.69 | 86 | Good | Poor |
| OLF Comp. 3 | Z-200 | 2.25 | None | 1.70 | 1.62 | 95 | Excellent | Poor |
| OLF Comp. 4 | Z-200 | 2.25 | None | 2.09 | 1.25 | 60 | Fair | Poor |
| OLF Comp. 5 | Z-200 | 2.25 | None | 1.97 | 1.60 | 81 | Good | Poor |
| OLF 6 | Z-200 | 2.00 | BVSM | 1.38 | 1.26 | 91 | Excellent | Excellent |
| OLF 7 | Z-200 | 2.00 | BVSME | 1.35 | 1.20 | 89 | Excellent | Excellent |

OLF = Active Olefin; Z-200 = acetoacetylated poly(vinylalcohol) (Gohsefimer Z-200, Nippon Gohsei); BVSM = bis-(vinylsulfonyl)-methane; BVSME = bis-(vinylsufonyl-methyl) ether The results indicate that significant enhancement of the waterfastness and wet adhesion properties of printed images, printed on acetoacetylated poly(vinylalcohol), can be achieved when an overcoat solution containing active olefins such as bis(vinylsulfonylmethyl)ether and bis (vinylsulfonyl)methane are overcoated onto the pigmented ink image. It has been unexpectedly found that when active olefins are used in conjunction with an ink-receiving layer containing an acetoacetylated poly(vinylalcohol), superior wet abrasion resistance is obtained versus an ink-receiving layer which is comprised of gelatin.

The invention has been described in detail with particular reference to certain preferred embodiments thereof, but it will be understood that variations and modifications can be effected within the spirit and scope of the invention.

What is claimed is:

1. A method of improving the durability of an ink jet ink image comprising the steps of:

a) providing an ink jet ink receiving layer containing acetoacetylated poly(vinylalcohol);

b) depositing pigment-based ink jet ink to form an image on the acetoacetylated poly(vinylalcohol)-containing ink receiving layer; and c) applying to the image formed in step b) a solution comprising a hardener.

2. The method of claim 1 wherein the solution is applied only to areas of the receiving layer bearing the image.

3. The method of claim 1 wherein the solution is applied to imaged and non-imaged areas of the receiving layer.

4. The method of claim 1 wherein the hardener is selected from the group consisting of organic compounds with aldehyde functional groups, blocked aldehyde functional groups, and active olefinic functional groups; and combinations thereof.

5. The method of claim 4 wherein said organic compound is selected from the group consisting of formaldehyde and dialdehydes.

6. The method of claim 5 wherein the organic compound is selected from the group consisting of the homologous series of dialdehydes ranging from glyoxal to adipaldehyde, diglycolaldehyde, and aromatic dialdehydes.

7. The method of claim 5 wherein the organic compound is selected from the group consisting of glutaraldehyde, succinaldehyde, and glyoxal.

8. The method of claim 4 wherein said organic compound is selected from the group consisting of blocked dialdehydes and N-methylol compounds.

9. The method of claim 8 wherein the organic compound is 2,3-dihydroxy-1,4-dioxane; tetrahydro-4-hydroxy-5-methyl-2(1H)-pyrimidinone polymers; polymers having a glyoxal polyol reaction product consisting of 1 anhydroglucose unit: 2 glyoxal units; DME-Melamine non-formaldehyde resins; N-methylol compounds obtained from the condensation of formaldehyde with various aliphatic or cyclic amides, ureas, and nitrogen heterocycles.

10. The method of claim 8 wherein the organic compound is 2,3-dihydroxy-1,4-dioxane.

11. The method of claim 4 wherein said organic compound is selected from the group consisting of active olefins and blocked active olefins.

12. The method of claim 11 wherein said active olefin is selected from the group consisting of divinyl ketone; resorcinol bis(vinylsulfonate); 4,6-bis(vinylsulfonyl)-m-xylene; bis(vinylsulfonylalkyl) ethers and amines; 1,3,5-tris (vinylsulfonyl) hexahydro-s-triazine; diacrylamide; 1,3-bis (acryloyl)urea; N,N'-bismaleimides; bisisomaleimides; bis (2-acetoxyethyl) ketone; and 1,3,5-triacryloylhexahydro-s-triazine; and said blocked active olefins is selected from the group consisting of bis(2-acetoxyethyl) ketone and 3,8-dioxodecane-1,10-bis(pyridinium perchlorate).

13. The method of claim 11 wherein said active olefin is bis-(vinylsulfonyl)-methane or bis(vinylsulfonylmethyl) ether.

14. The method of claim 1 wherein the hardener in the solution is between 0.10 and 5.0 weight percent of active ingredients in the solution.

15. The method of claim 14 wherein hardener in the solution is between 0.25 and 2.0 weight percent of active ingredients in the solution.

16. An ink jet receiving layer treated according to the method of claim 1.

17. An ink jet ink receiver comprising:

a support;

on the support, an ink jet ink receiving layer containing acetoacetylated poly(vinylalcohol);

on the ink receiving layer, an image formed by pigmented ink jet ink deposited thereon; and a fluid applied to the ink receiving layer, said fluid comprising a hardener.

18. The ink jet ink receiver of claim 17 wherein the fluid is applied only to areas of the receiving layer bearing the image.

19. The ink jet ink receiver of claim 17 wherein the solution is applied to imaged and non-imaged areas of the receiving layer.

* * * * *